US005112465A

United States Patent [19]

Danielson

[11] Patent Number: 5,112,465

[45] Date of Patent: May 12, 1992

[54] ELECTRODEPOSITION APPARATUS

[76] Inventor: George Danielson, 7682 Everest Cir., Huntington Beach, Calif. 92647

[21] Appl. No.: 622,002

[22] Filed: Dec. 4, 1990

[51] Int. Cl.[5] ..... C25C 1/10; C25C 7/00; C25C 7/04; C25D 21/04

[52] U.S. Cl. ..... 204/278; 204/279; 204/295

[58] Field of Search ..... 204/270, 278, 279, 295

[56] References Cited

U.S. PATENT DOCUMENTS 1,085,742 2/1914 Leffel ..... 204/278
1,838,666 12/1931 Fink et al. ..... 204/278 X
2,439,491 4/1948 Schiffl ..... 204/51 X
2,465,747 3/1949 Pessel ..... 204/278 X
4,592,819 6/1986 Suzuki et al. ..... 204/278 X

*Primary Examiner*—Donald R. Valentine
*Attorney, Agent, or Firm*—James E. Brunton

[57] ABSTRACT

A contamination control apparatus for sealable interconnection with plating tanks of the character used in the electrodeposition of an electrodeposit onto a substrate which is uniquely designed so as to permit the free escape of hydrogen, but to block the escape of most metal atoms released from the plating solution and to return them to the solution by force of gravity thereby eliminating the need for complex ventilating and fume scrubbing systems.

10 Claims, 1 Drawing Sheet

ELECTRODEPOSITION APPARATUS

BACKGROUND OF THE INVENTION

1. Field of the Invention

The present invention relates generally to apparatus for use in electrodeposition processes. More particularly, the invention concerns a novel hood construction for use in connection with electroplating tanks for efficiently capturing atoms of the plating materials which may be emitted from the plating solution.

2. Discussion of the Invention

Electrodeposition, or electroplating, is well understood by those skilled in the art and involves forming a layer of metal such as chromium, nickel or copper on an electrically conductive surface such as on an electrically conductive substrate. The principle of electroplating is that the coating metal is deposited from an electrolyte such as an aqueous acid or alkaline solution on to the substrate, i.e., the metal to be coated. The latter forms the cathode (negative electrode), while a plate of the metal to be deposited serves as the anode (positive electrode). A low-voltage direct current is used and the anode is gradually consumed. Various additions are frequently added to the electroplating bath to obtain a smooth and bright metal deposit. These are principally organic compounds, usually colloidal.

Electroplating is widely used in various industries including the automotive, furniture and metal fabricating industries. Component parts, such as automobile crank shafts, cam shafts and like wear parts, metal chair frames, machine tools and the like are routinely plated with chrome and like plating materials in plating apparatus which includes large tanks or vats adapted to receive the electrolyte, the substrate to be plated and the material which is to be deposited, that is the coating metal or electrodeposit.

A major problem in the plating industry is the prevention of contamination of the environment. Strict governmental regulations control the disposal of plating solutions and components, such as filters and fume scrubbers which have been contaminated during the electroplating process. Similarly, emission of contaminates from the plating apparatus into the atmosphere must be strictly controlled. Of particular concern is hexavalent chromium which is used principally inplating wear parts such as crank shafts, cam shafts and the like.

Hexavalent chromium electrolytes require a source of chromium and one or more catalysts in order to plate. The formulation of the traditional process contains hexavalent chromium and sulfate as a catalyst. Proprietary additives can be added to the hexavalent chromium plating bath formulation to enhance particular plating operations or the deposit's properties.

In order to control emissions from plating apparatus, including atoms of the electrodeposit, such as hexavalent chromium and nickel, elaborate ventilation ducting, filtering and scrubbing devices are operably associated with the plating tanks. The emission control apparatus is often large, complex and expensive to manufacture, install and maintain. Further, proper disposal of contaminated components of the emission control apparatus can be difficult and expensive.

Another problem inherent in prior art plating processes, particularly in chrome plating processes, is the efficient removal of hydrogen formed during the plating process. If hydrogen is not effectively removed, the hydrogen will deposit on the surface of the substrate being plated causing surface defects. This problem and a proposed solution thereto is disclosed in U.S. Pat. No. 4,419,194 issued to Angelini.

The apparatus of the present invention provides a simple, efficient and elegant solution to the problem of controlling emissions from the plating tank and for removing hydrogen produced during plating operations. More particularly, the apparatus of the invention efficiently captures the metal atoms released from the plating solution and returns them to the solution in a highly simple manner which totally obviates the need for complex and expensive ducting and fume scrubbing apparatus.

As will be better understood from the discussion which follows, the apparatus of the present invention replaces the complex prior art ducting, fume scrubbing and filtering systems with a unique hood designed that embodies a simple but highly efficient capture means. This unique capture means permits free passage of the hydrogen atoms emitted from the plating solution, but efficiently captures the metal atoms, such as chrome atoms, and returns them by force of gravity to the plating solution. Additionally, the apparatus of the present invention substantially reduces heat loss and eliminates the need to use expensive chemical additives for fume reduction, as for example, an additive sold by Millhorn Chemical of Maywood, Calif. under the trademark "FUMETROL 101". Further, the use of other fume control expedients such as polypropylene balls is avoided.

SUMMARY OF THE INVENTION

It is an object of the present invention to provide a contamination control apparatus for sealable interconnection with plating tanks of the character used in the electrodeposition of an electrodeposit onto a substrate which is uniquely designed so as to efficiently capture any metal atoms released from the plating solution and to return them to the solution by force of gravity.

Another object of the invention is to provide a contamination control apparatus of the character described which includes a thin, porous capture membrane which blocks the escape of metal atoms released from the plating solution but permits free passage of hydrogen gas emitted from the plating solution during the plating operation.

Another object of the invention is to provide a contamination control apparatus as described in the preceding paragraphs that includes an adapter assembly which is readily connected to the top walls of the plating tank and functions to sealably interconnect the plating tank with the capture hood which carries the capture membrane at a strategic location above the surface of the plating solution.

Another object of the invention is to provide an apparatus of the character described in which the adapter assembly is provided with a plurality of apertures for sealably receiving recirculation pipes and electrical conductors necessary to the operation of the plating process.

Another object of the contamination control apparatus of the present invention is to provide a simple, lightweight control hood assembly which totally eliminates the need for complex contamination control systems such as ventilation ducting, fume scrubbers, and filters of the character presently used in conjunction with plating processes.

Still another object of the invention is to provide an apparatus of the aforementioned character which eliminates the need to use expensive foaming agents and other additives designed to reduce fume production during the plating process.

Another object of the invention is to provide an apparatus of the character described in the proceeding paragraphs which significantly reduces heat loss from the plating tank thereby improving operating efficiencies and achieving substantial cost savings.

Yet another object of the invention is to provide an apparatus of the class described which substantially reduces water usage and maintenance and clean-up costs and when compared with conventional plating apparatus presently in use.

These and other objects of the invention are achieved by a contamination control apparatus for sealable interconnection with the plating tank of the character used in the electrodeposition of an electrodeposit onto a substrate for controlling the escape from the tank of electrodeposit material. In one form of the invention, the apparatus includes a hood having interconnecting sidewalls, an adapter unit sealably connected to the plating tank for interconnecting the hood with the plating tank and a capture membrane carried by the sidewalls of the hood for permitting the escape from the tank of hydrogen, but for substantially blocking the escape from the tank of the electrodeposit material.

DESCRIPTION OF THE INVENTION

Figure 1:
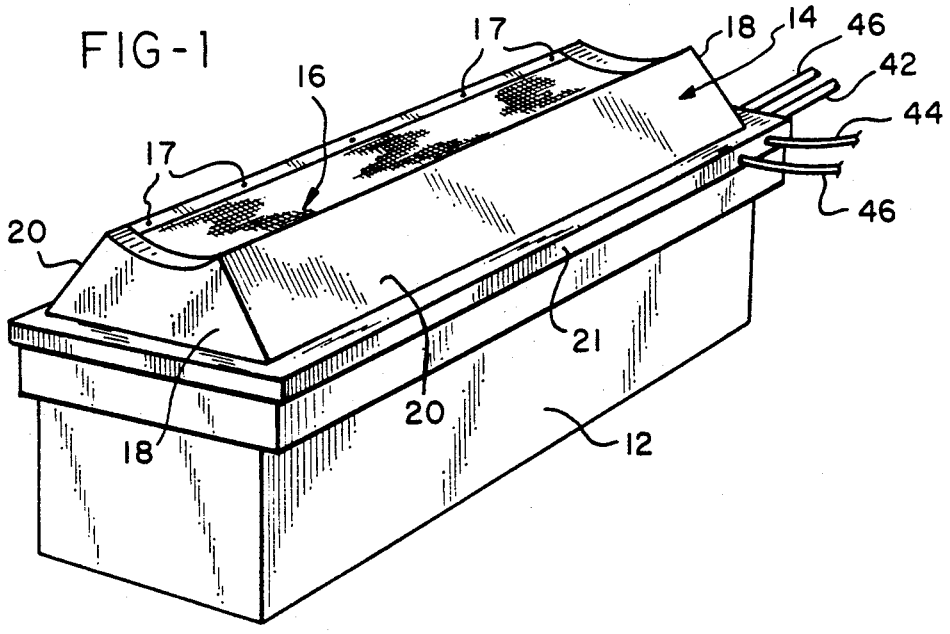
FIG. 1 is a generally perspective view of one form of the apparatus of the present invention.

Referring to the drawings, and particularly to FIG. 1, the apparatus of the present invention for electrodeposition of an electrodeposit onto a substrate comprises a tank 12 for containing an electrolyte or plating solution, a capture hood 14 adapted to fit over the tank 12 and capture mean carried by the capture hood 14 for preventing the escape from the tank of the electrodeposit material. In the form of the invention shown in the drawings, the capture means comprises a thin porous membrane 16 connected to hood 14. Membrane 16 is sealably connected to the hood proximate its open upper end and is suspended over the surface of the plating solution in the concave manner shown in FIG. 2.

Figure 2:
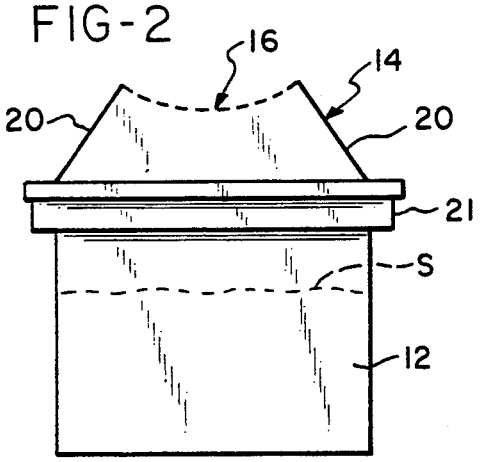
FIG. 2 is a side elevational view of the apparatus shown in FIG. 1.

As best seen by referring to FIGS. 1 and 2, hood 14 comprises longitudinally spaced, generally vertically extending end walls 18 which are interconnected with transversely spaced inwardly sloping sidewalls 20. As indicated in FIG. 1, the capture means sealably closes the upper open end of the hood which is defined by the upper extremities of the side and end walls of the hood 14. Membrane 16 is sealably interconnected with the side and end walls of the hood by soldering or by any appropriate mechanical means such as connectors 17 and drapes downwardly into the hood in the fashion illustrated in FIGS. 1 and 2. Membrane 16 can be constructed from various materials, including metals and plastics, and either tetrafluorethylene or stainless steel has proven satisfactory for use in connection with hexavalent chrome plating operations. In either case, the membrane is provided with a multiplicity of very fine micropores which are of a size to permit passage of hydrogen therethrough but are of a size to substantially block all metal atoms. The pore size of the micropores in membrane 16 will vary somewhat depending upon the material being electrodeposited. However, when chrome is being electrodeposited on a substrate, a tetrafluoroethylene or a stainless steel, fine-mesh screen, film, or foil of the compatible material, having the pore size of on the order of 0.2 to five microns has proven satisfactory for permitting the free passage of hydrogen atoms while effectively blocking the passage of chromium atoms therethrough.

Figure 3:
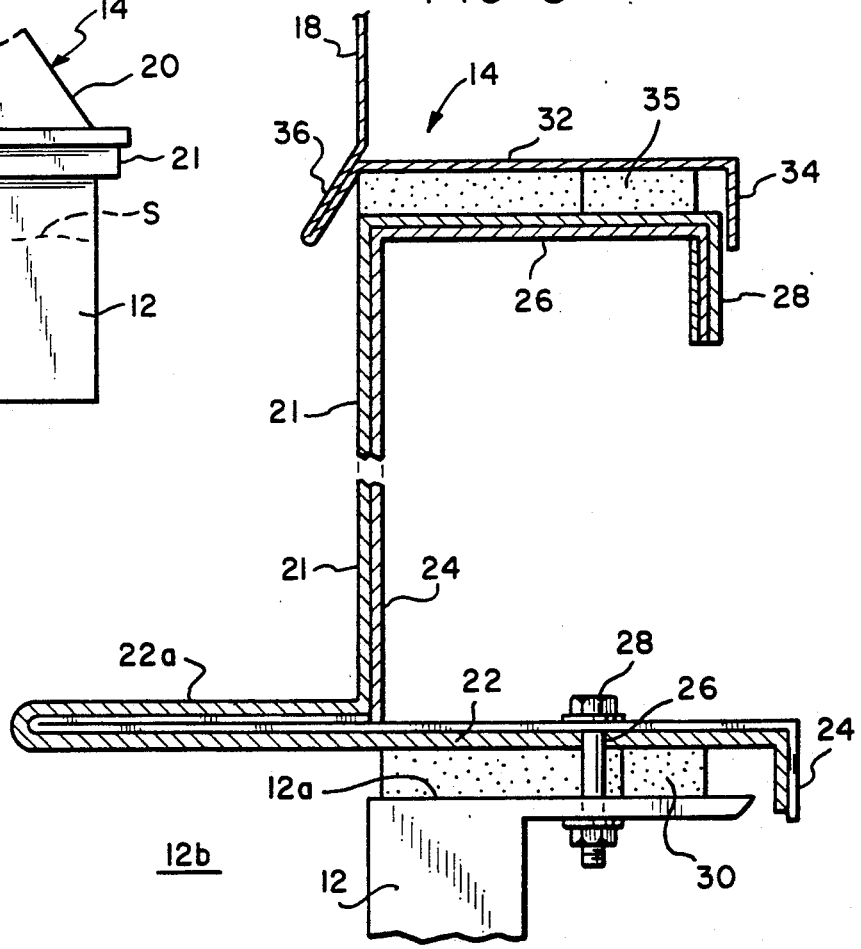
FIG. 3 is an enlarged cross-sectional view of the adapter assembly of the invention for use in interconnecting the control hood unit of the apparatus with the plating tank.

Hood 14 is preferably interconnected with the plating tank by means of an adapter means or unit 21 which is sealably connected to the plating tank and functions to sealably interconnect the hood with the tank. Referring particularly to FIG. 3, one form of the adapter unit of the apparatus of the present invention is there illustrated. The adapter unit there shown comprises a base wall 22 including a downwardly depending lip 24. Connected to base wall 22 is an upwardly extending wall 24 which, in turn, is connected to a generally horizontally extending top wall 26. Top wall 26 also includes a downwardly depending lip portion 28. As indicated in FIG. 3, bottom wall 22 extends laterally inwardly of tank 12 and is bent back upon itself to form a peripherally extending flange **22*a* which circumscribes the upper opening 12*b* of the tank and joins with upstanding wall 24. To interconnect the adapter with the tank, base wall 22 is provided with a plurality of longitudinally spaced apertures 26 which receive fasteners such as hold-down bolts 28. To provide an appropriate seal between the adapter unit and the upper surface of tank 12, a yieldably deformable sealing gasket 30 is deposed intermediate base wall 22 and the top wall 12*a* of the tank 12**.

In the present form of the invention, hood 14 includes a base wall 32 having a downwardly depending, peripherally extending flange 34 which is adapted to fit over top wall 26 and lip 28 of the adapter unit in the manner illustrated in FIG. 3. Once again, an appropriate sealing material 35 is interposed between base wall 32 of the capture hood and top wall 26 of the adapter unit. The outboard edge of base wall 32 of the capture hood unit is formed to define an angularly downwardly depending peripheral flange 36 which circumscribes the lower perimeter of the hood and functions as a drip shield for condensates forming on end and sidewalls 18 and 20 of the hood unit.

In addition to functioning as an adapter or connector means for interconnecting the control hood with the plating tank, the adapter unit also uniquely functions as a means for passage of fluid conduits 40 and 42 and electrical conduits 44 and 46 into the interior of the apparatus. Fluid conduits 40 and 42 provide a means for recirculating and agitating the plating solution within the tank, while electrical conduits 44 and 46 provide electrical power to the plating electrodes.

In using the apparatus of the invention, the sealing material 30 is first placed over the upper planar surface **12*a* of the tank 12 in the manner shown in FIG. 3. Next, the base wall 22 of the adapter unit is securely bolted to the top of the tank using fasteners such as bolt 26. With the adapter unit secured to the tank 12, the fluid conduits and electrical conductors are inserted through the apertures provided in side wall 21 of the adapter unit and are appropriately sealed. This done, internal connections are made and the sealing gasket or sealing material 34 is placed upon upper horizontally extending walls 26 of the adapter unit. Next, and the hood 18 is placed over the adapter unit in the manner shown in FIG. 3 with lip 34 overhanging lip 28 of the adapter unit. With the hood unit thusly emplaced over the adapter unit, the capture means, or porous stainless steel membrane 16 can be suitably affixed to the upper edges of the side and end walls of hood 18 using the appropriate fasteners 17 (FIG. 1). In some applications, membrane 16 is affixed to hood 18 prior to mounting the hood on the adapter unit. In any event, the membrane is connected to the hood so that the edges of the membrane sealably engage the edges of the end and side walls of hood 18 and so that the membrane drapes downwardly within the hood in the manner shown in FIG. 2. When so positioned, membrane 16 is generally arcuate in cross-section as indicated in FIG. 2 so that condensate forming on the lower surface of the membrane will tend to fall by force of gravity toward the opening 12***b* in the plating tank.

During the plating operation, fumes laden with hydrogen and the electrodeposit material, such as chromium will rise toward the sloping side walls of the hood and toward membrane 16. Due to the microporous character of the membrane, the hydrogen will freely escape but the electrodeposit material will be blocked by the membrane and will fall by force of gravity back into the tank. Similarly, electrodeposit material striking the sloping side walls of the hood will fall back into the tank. With this unique arrangement, atmospheric contamination is prevented without the use of complex and expensive ventilation and fume scrubber systems.

Having now described the invention in detail in accordance with the requirements of the patent statutes, those skilled in the art will have no difficulty in making changes and modifications in the individual parts or their relative assembly in order to meet specific requirements or conditions. Such changes and modifications may be made without departure from the scope and spirit of the invention, as set forth in the following claims.

I claim:

1. An apparatus for electro depositing chrome onto a substrate comprising:

(a) a tank for containing a plating solution;

(b) an adapter assembly connected to said tank;

(c) an open top hood connected to said adapter assembly; and (d) a thin, stainless steel membrane connected to said hood and extending over said open top, said membrane having a multiplicity of fine pores of a size to permit passage of hydrogen there through but of a size to substantially prevent the passage of chromium atoms therethrough.

2. An apparatus as defined in claim 1 in which said pores in said membrane are between about one and about five microns.

3. An apparatus as defined in claim 1 in which said adapter means comprises:

(a) a base wall including a downwardly depending lip receivable within said tank;

(b) an upstanding wall connected to said base wall; and (c) a top wall connected to said upstanding wall, said top wall including a downwardly depending lip.

4. An apparatus as defined in claim 3 in which said upstanding wall of said adapter means is provided with first apertures for sealably receiving conduit means for conducting plating solution toward and away from said tank and is provided with second apertures for sealably receiving electrical conductors.

5. A contamination control apparatus for sealable interconnection with a plating tank of the character used in the electrodeposition of an electrodeposit onto a substrate for controlling the escape from the tank of the electrodeposit material, said apparatus comprising:

(a) a hood having interconnected side walls;

(b) adapter means sealably connected to the plating tank for interconnecting said sidewalls of said hood with the plating tank; and (c) capture means carried by said sidewalls of said hood for permitting the escape from the tank of hydrogen, but substantially preventing the escape from the tank of the electrodeposit material, said capture means comprising a thin, porous membrane having a multiplicity of pores of a size that will permit passage of hydrogen but will block passage of atoms of the electrodeposit material.

6. An apparatus as defined in claim 5 in which said membrane said pores are between 0.2 and 5 microns.

7. An apparatus as defined in claim 5 in which said sidewalls of said hood have upper edges and in which said membrane is sealably connected to said membrane proximate said upper edges.

8. An apparatus as defined in claim 7 in which said membrane is substantially arcuate in cross-section.

9. An apparatus for electro deposition of an electro deposit onto a substrate comprising:

(a) a tank for containing a plating solution;

(b) a hood adapted to fit over said tank, said hood having interconnected side and end wall, said walls having upper edges; and (c) a thin porous membrane suspended between said side and end walls, said membrane having a multiplicity of pores of a size that will permit the passage of hydrogen there through but will substantially prevent the passage of the electrodeposit material therethrough, said thin porous membrane being constructed from tetrafluoroethylene.

10. An apparatus as defined in claim 9 further including adapter means disposed intermediate said tank and said hood for sealably interconnecting said hood with said tank.

* * * * *